US009774981B2

(12) United States Patent
Jin et al.

(10) Patent No.: US 9,774,981 B2
(45) Date of Patent: Sep. 26, 2017

(54) AUDIO RENDERING SYSTEM

(71) Applicant: Huawei Technologies Co., Ltd., Shenzhen (CN)

(72) Inventors: Wenyu Jin, Munich (DE); Willem Bastiaan Kleijn, Lower Hutt (NZ); David Virette, Munich (DE)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 249 days.

(21) Appl. No.: 14/725,063

(22) Filed: May 29, 2015

(65) Prior Publication Data

US 2015/0264510 A1 Sep. 17, 2015

Related U.S. Application Data

(63) Continuation of application No. PCT/EP2012/074146, filed on Nov. 30, 2012.

(51) Int. Cl.
*H04S 7/00* (2006.01)

(52) U.S. Cl.
CPC ..... *H04S 7/307* (2013.01); *H04S 7/30* (2013.01); *H04S 2400/11* (2013.01)

(58) Field of Classification Search
None
See application file for complete search history.

(56) References Cited

U.S. PATENT DOCUMENTS

2007/0019815 A1 1/2007 Asada et al.
2007/0133813 A1 6/2007 Morishima
2010/0008517 A1 1/2010 Elko et al.
2010/0098274 A1 4/2010 Hannemann et al.

FOREIGN PATENT DOCUMENTS

CN 1901760 A 1/2007
CN 1922924 A 2/2007

OTHER PUBLICATIONS

Foreign Communication From a Counterpart Application, Chinese Application No. 201280076887.1, Chinese Office Action dated May 5, 2016, 7 pages.
Foreign Communication From a Counterpart Application, Chinese Application No. 201280076887.1, Chinese Search Report dated Apr. 26, 2016, 2 pages.
Poletti, M., "An Investigation of 2D Multizone Surround Sound Systems," Audio Engineering Society 125th Convention, Convention Paper 7551, Oct. 2-5, 2008, pp. 167-175.
Teal, P., et al., "An Algorithm for Power Constrained Holographic Reproduction of Sound," ICASSP, 2010, pp. 101-104.
Williams, E., "Fourier Acoustics: Sound Radiation and Nearfield Acoustical Holography," Academic Press, 1999, 321 pages.
Daniel, J., et al., "Further Investigations of High Order Ambisonics and Wavefield Synthesis for Holophonic Sound Imaging," Presented at the 114th Convention, Audio Engineering Society, Convention Paper 5788, Mar. 22-25, 2003, 18 pages.
(Continued)

*Primary Examiner* — Paul Huber
(74) *Attorney, Agent, or Firm* — Conley Rose, P.C.

(57) ABSTRACT

An audio rendering system is provided that comprises a plurality of loudspeakers arranged to approximate a desired spatial sound field within a predetermined reproduction region, wherein the loudspeakers are configured to approximate the sound field based on a weighted series of orthonormal basis functions for the reproduction region.

15 Claims, 6 Drawing Sheets

(56) References Cited

OTHER PUBLICATIONS

Choi, J., et al., "Generation of an acoustically bright zone with an illuminated region using multiple sources," Acoustical Society of America, vol. 111, No. 4, Apr. 2002, pp. 1695-1700.
Golub, G., et al., "Matrix Computations" Third Edition, Oct. 7, 1996, 169 pages.
Park, J., et al., "Personal stereophonic system using loudspeakers: feasibility study," International Conference on Control, Automation and Systems, Oct. 14-17, 2008, 5 pages.
Radmanesh, N., et al., "Reproduction of Independent Narrowband Soundfields in a Multizone Surround System and ITS Extension to Speech Signal Sources," School of Electrical and Computer Engineering, ICASSP, 2011, pp. 461-464.
Wu, Y., et al., "Spatial Multizone Soundfield Reproduction," ICASSP, 2009, pp. 93-96.
Abhayapala, T., et al., "Spatial soundfield reproduction with zones of quiet," Presented at the 127th Convention, Audio Engineering Society, Convention Paper 7887, Oct. 9-12, 2009, 7 pages.
Messerschmitt, D., et al., "Stationary points of a real-valued function of a complex variable," Electrical Engineering and Computer Sciences University of California at Berkeley, Technical Report No. UCB/EECS-2006-93, Retrieved from URL: http://www.eecs.berkeley.edu/Pubs/TechRpts/2006/EECS-2006-93.html, Jun. 27, 2006, 8 pages.
Wu, Y., et al., "Theory and Design of Soundfield Reproduction Using Continuous Loudspeaker Concept," IEEE Transactions on Audio, Speech, and Language Processing, vol. 17, No. 1, Jan. 2009, pp. 107-116.
Betlehem, T., et al., "A Constrained Optimization Approach for Multi-Zone Surround Sound," ICASSP, 2011, pp. 437-440.
Wu, Y., et al., "Multizone 2D Soundfield Reproduction Via Spatial Band Stop Filters," IEEE Workshop on Applications of Signal Processing to Audio and Acoustics, Oct. 18-21, 2009, pp. 309-312.
Ward, D., et al., "Reproduction of a Plane-Wave Sound Field Using an Array of Loudspeakers," IEEE Transactions on Speech and Audio Processing, vol. 9, No. 6, Sep. 2001, pp. 697-707.
Foreign Communication From a Counterpart Application, PCT Application No. PCT/EP2012/074146, International Search Report dated Jul. 10, 2013, 5 pages.
Foreign Communication From a Counterpart Application, PCT Application No. PCT/EP2012/074146, Written Opinion dated Jul. 10, 2013, 7 pages.
Foreign Communication From a Counterpart Application, European Application No. 12795419.6, European Office Action dated Mar. 14, 2016, 6 pages.
Wikipedia, "Least squares," Retrieved from the internet: URL:https://en.wikipedia.org/wiki/Least_squares, 9 pages.

AUDIO RENDERING SYSTEM

CROSS-REFERENCE TO RELATED APPLICATIONS

This application is a continuation of International Application No. PCT/EP2012/074146, filed on Nov. 30, 2012, which is hereby incorporated by reference in its entirety.

TECHNICAL FIELD

The present invention relates to an audio rendering system such as an audio conferencing system and a method for sound field reproduction, in particular, a spatial multi-zone sound field reproduction using multi-loudspeaker arrangements.

BACKGROUND

Multi-zone sound field reproduction is a technique that aims at providing an individual sound environment to each listener without physically isolated regions or the use of headphones. With the increased need for personalized sound environments in the fast growing entertainment and communication field, spatial multi-zone sound field reproduction over an extended region of open space has conducted to the definition of several solutions, such as described by M. Poletti "An investigation of 2D multizone surround sound system" Proc. AES 125th Convention Audio Eng. Society, 2008; N. Radmanesh and I. S. Burnett "Reproduction of independent narrowband soundfields in a multizone surround system and its extension to speech signal sources" Proc. IEEE ICASSP, 11:598-610, 2011 and Y. J. Wu and T. D. Abhayapala "Spatial multizone soundfield reproduction" Proc. IEEE ICASSP, pages 93-96, 2009.

Spatial multi-zone sound field reproduction is a complex and challenging problem in the area of acoustic signal processing. The key objective is to provide the listener with a good sense of localization by precisely reproducing the desired sound field in the designated bright zone, while also controlling the acoustical brightness contrast between the bright zone and quiet zone. The region that features high acoustical brightness at a specified frequency is defined as the bright zone and the region that features low acoustical brightness is defined as the quiet zone. The acoustical brightness of a zone at a particular frequency is defined as the space-averaged potential energy density at that frequency. The acoustic energy density is proportional to the square of the pressure complex magnitude, which is the sound field magnitude squared. Ideally the acoustic energy density of a quiet zone is set to be zero, however, in practice it is generally small relative to other zones. In that case, the objective is to achieve an acoustical brightness contrast, which is defined by the power ratio between quiet and bright zones.

Using a linear loudspeaker array consisting of sixteen speakers, Ivan Tashev, Jasha Droppo and Mike Seltzer have demonstrated that sound waves cancel each other out in one area and become amplified in another. Someone stepping even a few paces to the side of the designated sound field can not hear the music. A preliminary theoretical study was performed in J. Daniel, R. Nicol, and S. Moreau "Further investigations of high order ambisonics and wavefield synthesis for holophonic sound imaging" Proc. AES 114th Convention Audio Eng. Society, 51:425, 2003, which introduced higher order ambisonics (HOA) to reproduce sound fields in multi-zones on the basis of mode matching. In 2008, Poletti proposed an alternative approach using least-squares matching to generate a 2-dimensional (2-D) monochromatic sound field in a multi-zone surround system. This was based on the computation of a circular loudspeaker aperture function which allows for a sound source positioned within or on a ring of speakers. Further investigation was made by N. Radmanesh and I. S. Burnett to extend the work to two multi-frequency sources and then to narrowband speech signals.

However, none of the activities mentioned above provides a precise control on the sound leaked from one zone into other specified zones. In T. Betlehem and P. Teal "A constrained optimization approach for multizone surround sound" Proc. IEEE ICASSP, pages 437-440, 2011, a method was proposed to control the sound in each zone independently, while also controlling the leakage into other listeners' zones. A constrained optimization similar to P. D. Teal, T. Betlehem, and M. Poletti "An algorithm for power constrained holographic reproduction of sound" Proc. IEEE ICASSP, pages 101-104, March 2010, for determining the loudspeaker weights that minimize the mean square error (MSE) of reproduction in the control region was used. They incorporated a constraint on the summed square value of the loudspeaker weights to improve the system robustness. A method was proposed in J. W. Choi and Y. H. Kim "Generation of an acoustically bright zone with an illuminated region using multiple sources" JASA, 111:1695-1700, 2002, to make an acoustically bright zone (the zone of high acoustic potential energy) by using multiple control sources at a particular frequency. An acoustic contrast control method was introduced to maximize the acoustical brightness contrast between two zones (bright and quiet zones). A sound focused personal audio system for a mono sound was implemented as an example application and a pressure difference of up to 20 decibels (dB) between the bright and dark zone was demonstrated. In J.-Y. Park, J.-H. Chang, Y-H. Kim, and Y. Park "Personal stereophonic system using loudspeakers: feasibility study" International Conference on Control, Automation and Systems, October 2008, the acoustic contrast control method was further applied to a personal stereophonic system and the results demonstrated that a channel separation of over 20 dB can be obtained in the bright zone chosen around each ear. These methods are limited to the control of the acoustic energy contrast between two different zones and the outcome of this approach fails to control the sound field. Indeed, they do not provide a sense of localization for the listener in the bright zone.

In Y. J. Wu and T. D. Abhayapala "Spatial multizone soundfield reproduction" Proc. IEEE ICASSP, pages 93-96, 2009, a framework was proposed to recreate multiple 2-D sound fields at different locations within a single circular loudspeaker array by cylindrical harmonics expansions. They derived the desired global sound field by translating individual desired sound fields to a single global co-ordinate system and applying appropriate angular window functions. An improved method of using spatial band stop filtering over the quiet zone to suppress the leakage from the nearby desired sound field was proposed in Y. Wu and T. Abhayapala "Multizone 2D soundfield reproduction via spatial band stop filters" IEEE WASPAA, pages 309-312, 2009. However, both of these two methods were based on the idea of canceling the undesirable effects on the other zones by using extra spatial modes (harmonics). The drawback for this approach is that it is only able to create quiet zones outside the designated reproduction region, which renders the method not useful for practical applications. The reproduction region defines the total control zone of interest for the rendering of a desired sound field. Only the bright zone can be included in this zone of interest, the quiet zone can only be obtained outside this reproduction region. This reproduction region is at least delimited by the loudspeakers and usually limited to a small area.

The methods described in prior art do not provide the listener with a good sense of localization by precisely reproducing the desired sound field in the designated bright zone, while also controlling the acoustical brightness contrast between the bright zone and quiet zone in an efficient way. Prior art can only partly achieve this goal by either reconstructing a sound field or providing acoustical brightness contrast between two zones without localization information. T. Betlehem, P. D. Teal "A constrained optimization approach for multi-zone surround sound" Proc. IEEE ICASSP, pages 437-440, 2011 has described a method to achieve both acoustical brightness contrast and sound field reconstruction based on convex optimization, but the computational complexity of such method makes it hardly implementable in practical applications.

SUMMARY

It is the object of the invention to provide a technique for improved reproduction of a desired sound field within a designated reproduction region.

This object is achieved by the features of the independent claims. Further implementation forms are apparent from the dependent claims, the description and the figures.

The invention is based on the finding that modeling a desired multi-zone sound field as an orthogonal expansion of basis functions over the desired reproduction region, wherein the orthogonality implies that the inner product of any two basis functions in the set over the desired reproduction region is 0, results in the Helmholtz solution that is closest to the desired sound field, in the weighted least squares sense, and can best reproduce it. The basis orthogonal set can be formed by, for example, using a Gram Schmidt process with a set of solutions of the Helmholtz equation as input (assuming the set is complete). Alternatively, the "Householder transformation" can be used to construct the orthogonal set.

Generally the set of input solutions is not orthogonal, which makes it cumbersome to work with them. The Gram Schmidt process enables constructing the basis functions of the orthonormal set as linear combinations of the basis wavefields, e.g. plane waves and circular waves. The coefficients of the basis wavefields can then be calculated, which enables to apply the existing reproduction methods to reproduce the desired multi-zone sound field within the reproduction region using an enclosed circular loudspeaker array. By applying an optimized semi-circle reproduction method, a semi-circle loudspeaker array can be used that requires approximately half of the loudspeakers as introduced in the existing methods.

Such technique provides an improved reproduction of the desired sound field within the designated reproduction region, as will be presented in the following.

In order to describe the invention in detail, the following terms, abbreviations and notations will be used.

Audio rendering: A reproduction technique capable of creating spatial sound fields in an extended area by means of loudspeakers or loudspeaker arrays.

Sound field: Sound sources cause oscillation of a surrounding medium, such as air, water or a solid. The oscillation then propagates as a pressure wave (sound wave) through the medium. A sound field is a complex number that indicates the amplitude and phase of the sound pressure wave at a particular point in space for a particular frequency. In air, the sound field can be measured as a pressure field by using pressure sensors which are referred to as microphones.

Acoustical brightness: The overall acoustical brightness of a zone is expressed by space-averaged potential energy density. The acoustic potential energy density is proportional to the square of the pressure complex magnitude, which is the sound field magnitude squared. The acoustical brightness of a zone at a particular frequency is defined as the space-averaged potential energy density at that frequency. The acoustic energy density is proportional to the square of the pressure complex magnitude, which is the sound field magnitude squared at that frequency.

Bright zone: The defined region features high acoustical brightness at a certain frequency, the zone of high acoustic potential energy. The high acoustical brightness indicates that the acoustic energy is close to the energy of the desired sound field.

Quiet zone: The defined region features low acoustical brightness at a certain frequency. Ideally the potential energy density of this region is set to be zero, however, in practice it is generally small relative to other zones. The low acoustical brightness indicates that the acoustic energy is small compared to the bright zone. This can be measured by the acoustical brightness contrast which is defined by the power ratio between quiet and bright zones. The acoustical brightness is, for example, considered as low when the achieved acoustical brightness contrast is at least 15 dB.

Desired reproduction region: The total control zone of interest. Both bright zone and quiet zone can be included in the desired reproduction region. The reproduction region, the bright zone and the quiet zone may have a circular shape, a square shape, a channel shape, a fan shape, or other shapes.

Leakage region: The region outside the desired reproduction region. It receives any uncontrolled leakage acoustic energy.

According to a first aspect, the invention relates to an audio rendering system, comprising a plurality of loudspeakers arranged to approximate a desired spatial sound field within a predetermined reproduction region, wherein the loudspeakers are configured to approximate the sound field based on a weighted series of orthonormal basis functions for the reproduction region.

The desired spatial sound field may be a fixed sound field which does not evolve with the time, or can be a dynamic sound field from which the acoustical properties may change with the time.

Such a configuration of the loudspeakers provides a straightforward way with less computational effort to construct the desired sound field within the desired reproduction region.

The audio rendering system facilitates a reduction in the number of activated loudspeakers introduced to reproduce the desired sound field. The loudspeaker arrangement is not restricted to a circular array of loudspeakers.

In case of a fixed sound field, the number of loudspeakers required to reproduce such sound field is reduced. In case of a dynamic sound field, the number of simultaneously activated loudspeakers can also be reduced compared to the prior art.

In a first possible implementation form of the audio rendering system according to the first aspect, the weights of the weighted series are adjusted for approximating the desired sound field.

In a second possible implementation form of the audio rendering system according to the first aspect as such or according to the first implementation form of the first aspect, the loudspeakers are configured to reproduce the desired sound field at a predetermined frequency.

The audio rendering system is able to work over a broader working range of frequency up to 10 kilohertz (KHz).

In a third possible implementation form of the audio rendering system according to the first aspect as such or according to any of the preceding implementation forms of the first aspect, the sound field comprises at least one bright zone and at least one quiet zone.

The audio rendering system provides a good sense of localization that can be created by precisely reproducing the desired sound field in the designated bright zone, while also providing accurate controlling of the acoustical brightness. The bright zone and the quiet zone can be flexibly located in the desired reproduction region.

In case the desired spatial sound field is a dynamic sound field, the quiet zone and bright zone may be even moved inside the reproduction region.

Ideally the acoustic energy density of a quiet zone is set to be zero. However, in practice this is typically not possible and can only be approximated. Therefore, a further objective of implementation forms of the invention is to minimize the acoustic energy of a quiet zone, absolute or relative to the bright zone. In the latter case, the objective is, for example, to achieve an acoustical brightness contrast, which is defined by the power ratio between quiet zone and bright zone, of at least 15 dB, and more than 20 dB in the best case.

In a fourth possible implementation form of the audio rendering system according to the third implementation form of the first aspect, the weighted series of orthonormal basis functions is adapted such that an acoustical brightness contrast, which is defined by the power ratio between the at least one quiet zone and the at least one bright zone, is at least 15 dB or at least 20 dB.

In a fifth possible implementation form of the audio rendering system according to the first aspect as such or according to any of the preceding implementation forms of the first aspect, the weights of the weighted series are adjusted by determining a weighted least squares solution of the weighted series of orthonormal basis functions with respect to the desired sound field.

In a sixth possible implementation form of the audio rendering system according to the fifth implementation form of the first aspect, the weighted least squares solution is according to:

$$\min_{C_n} \int_D P \sum_n C_n G_n(x, k) - S(x, k) P^2 w(x)\, dx.$$

where S(x,k) denotes the desired sound field, $G_n(x,k)$ denotes the orthonormal basis functions, $C_n$ denotes the weights of the weighted series, w(x) denotes a weighting function and D denotes the desired reproduction region.

In a seventh possible implementation form of the audio rendering system according to the fifth implementation form or according to the sixth implementation form of the first aspect, the sound field comprises at least one bright zone, at least one quiet zone and a remaining unattended zone in the desired reproduction region, wherein a weighting function of the weighted least squares solution depends on the at least one bright zone, the at least one quiet zone and on the remaining unattended zone in the desired reproduction region.

In a eighth possible implementation form of the audio rendering system according to the seventh implementation form of the first aspect, the weighting function of the weighted least squares solution comprises at least a first weight over the at least one bright zone, a second weight over the at least one quiet zone and a third weight over the unattended zone.

In a ninth possible implementation form of the audio rendering system according to the first aspect as such or according to any of the preceding implementation forms of the first aspect, the orthonormal basis functions are derived from at least a set of plane waves or a set of circular waves.

In a tenth possible implementation form of the audio rendering system according to the first aspect as such or according to any of the preceding implementation forms of the first aspect, the orthonormal basis functions are formed by using a Gram Schmidt process with a set of solutions of the Helmholtz equation as input or by using a Householder transformation.

In an eleventh possible implementation form of the audio rendering system according to the tenth implementation form of the first aspect, the Gram Schmidt process is applied on a set of one of plane waves and circular waves.

In a twelfth possible implementation form of the audio rendering system according to the eleventh implementation form of the first aspect, the configuration of the loudspeakers for approximating the desired sound field based on the weighted series of orthonormal basis functions is computed based on known weights of the loudspeakers for each wave of the set of plane waves or the set of circular waves.

In a thirteenth possible implementation form of the audio rendering system according to the first aspect as such or according to any of the preceding implementation forms of the first aspect, the plurality of loudspeakers are arranged on a circle, a semi-circle, a quarter-circle, a square or a line.

According to a second aspect, the invention relates to a method for sound field reproduction, the method comprising arranging a plurality of loudspeakers for approximating a desired spatial sound field within a predetermined reproduction region, wherein the loudspeakers are configured to approximate the sound field based on a weighted series of orthonormal basis functions for the reproduction region; and adjusting the weights of the weighted series for approximating the desired sound field.

According to a third aspect, the invention relates to a method for reproducing a sound field within a desired reproduction region at a certain frequency, the method comprising modeling the sound field as an orthogonal expansion of basis functions for the desired reproduction region; forming the orthogonal expansion of basis functions by using a Gram Schmidt process; calculating coefficients of the basis functions; and determining loudspeaker weights for the sound field based on the calculated coefficients.

In a first possible implementation form of the method according to the third aspect, the determining the loudspeaker weights is based on a weighting of the sound field within the desired reproduction region.

According to a fourth aspect, the invention relates to a method of describing an arbitrary sound field within a desired reproduction region at a certain frequency as an orthogonal expansion of basis functions which is used to obtain the desired sound field. In a first implementation form of the fourth aspect, the desired sound field comprises at least one bright zone and one quiet zone. In a second implementation form of the fourth aspect, the basis orthogonal set is determined from a set of plane waves and/or circular waves. In a third implementation form of the fourth aspect, the basis orthogonal set is determined in a training phase. In a fourth implementation form of the fourth aspect, the basis orthogonal set is determined off-line.

According to a fifth aspect, the invention relates to a method of describing an arbitrary sound field within a desired reproduction region at a certain frequency, the method comprising describing the desired sound field as an orthogonal expansion of basis functions for the desired reproduction region; forming the basis orthogonal set by using a Gram Schmidt process that has a set of solutions of the Helmholtz equation, in particular by having plane waves or circular waves as input of the Gram Schmidt process; calculating coefficients of the basis functions; and designing loudspeaker weights for the desired sound field by using a conventional reproduction method based on the calculated coefficients. The basis orthogonal set can be determined by training or off-line.

Aspects of the invention provide a new method of precisely describing a desired sound field as an orthogonal expansion of basis functions for the desired reproduction region. If the desired sound field does not satisfy the physical constraints, then the method will find the Helmholtz solution that is closest to and can best reproduce the desired sound field, in the least squares sense. In an implementation form, the basis orthogonal set is formed using Gram Schmidt process with a set of solutions of the Helmholtz equation as input (assuming the set is complete). As generally the set of input solutions is not orthogonal it is cumbersome to work with them. The Gram Schmidt process, however, enables constructing the basis functions of the orthonormal set as linear combinations of the basis wavefields, e.g., by using plane waves and/or circular waves. The coefficients of the basis wavefields can then be calculated for reproducing the desired sound field within the reproduction region using a discrete loudspeaker array.

The methods, systems and devices described herein may be implemented as software in a Digital Signal Processor (DSP), in a micro-controller or in any other side-processor or as hardware circuit within an application specific integrated circuit (ASIC).

The invention can be implemented in digital electronic circuitry, or in computer hardware, firmware, software, or in combinations thereof, e.g. in available hardware of conventional mobile devices or in new hardware dedicated for processing the audio enhancement system.

BRIEF DESCRIPTION OF THE DRAWINGS

Further embodiments of the invention will be described with respect to the following figures, in which.

DETAILED DESCRIPTION

Figure 1:
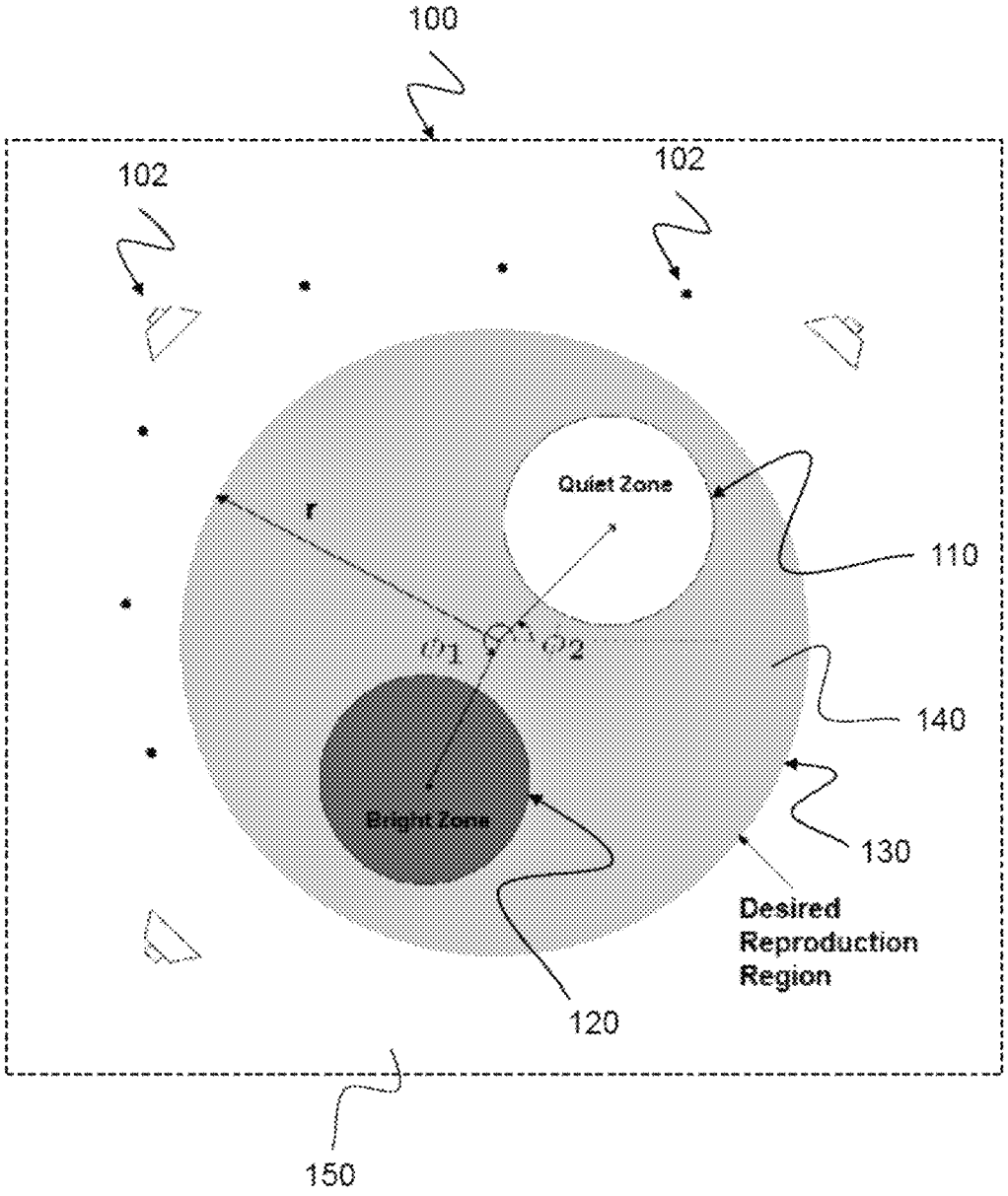
FIG. 1 shows a schematic diagram of an audio rendering system according to an implementation form.

FIG. 1 shows a schematic diagram of an audio rendering system 100 according to an implementation form.

In FIG. 1, the desired reproduction region D 130 is the total control circular zone of interest with a radius of r, which comprises both, an acoustically circular bright zone 120 and a circular quiet zone 110. The region that features high acoustical brightness at a specified frequency is defined as the bright zone $D_b$ 120 and the region that features low acoustical brightness as the quiet zone $D_q$ 110. The bright zone 120 and the quiet zone 110 are defined by their angles $\Phi_1$ and $\Phi_2$ respectively with respect to the center of the desired reproduction region 130. Ideally the acoustic energy density of a quiet zone 110 is set to be zero, however in practice it is generally small relative to other zones. The remaining area in the desired reproduction region 130 is defined as the unattended zone 140. The region outside the desired reproduction region 130 is defined as the leakage region 150. It receives any uncontrolled leakage acoustic energy. The number of employed loudspeakers 102 is Q and the q th loudspeaker weight is denoted as $l_q(k)$, where $k=2\pi f/c$ is the wavenumber, $f$ is the frequency and c is the speed of sound propagation.

The acoustical brightness of a zone at a particular frequency is defined as the space-averaged potential energy density at that frequency. The acoustic energy density is proportional to the square of the pressure complex magnitude, which is the sound field magnitude squared. Therefore, the system performance can be evaluated with this definition by measuring the acoustical brightness contrast between the selected bright zone and quiet zone:

$$B(k) = \frac{\int_{D_b} |S(x, k)|^2 \, dx / S_b}{\int_{D_q} |S(x, k)|^2 \, dx / S_q},$$

where B(k) denotes the acoustical brightness contrast, x denotes an arbitrary spatial observation point and k is a normalized frequency referred to as the wave number. $S_b$ and $S_q$ mark the sizes of the bright and the quiet zones respectively.

One possibility to measure or quantify the accuracy of the reproduction sound field compared to the desired sound field, or in other words the degree of approximation between the reproduction sound field and the desired sound field to be approximated, is to determine the mean square error (MSE) $\epsilon_M(k)$ of the reproduction as the average squared difference between the entire desired sound field $S^d(x,k)$ and the entire corresponding reproduced sound field $S^a(x,k)$ (both normalized) over the selected bright zone $D_b$ $$\varepsilon_M(k) = \frac{\int_b |S^d(x, k) - S^a(x, k)|^2 \, dx}{\int_b |S^d(x, k)|^2 \, dx}.$$

The smaller the MSE $\epsilon_M(k)$, the better the accuracy or approximation.

In this implementation form, the desired reproduction region 130, the bright zone 120 and the quiet zone 110 are circular and there is only one bright zone 120 and one quiet zone 110 inside the desired reproduction zone 130. In another implementation form, there are more than one bright zones and/or more than one quiet zones. In another implementation form, the desired reproduction region 130 has another geometrical form, e.g. is formed as a square, as an ellipse, as a triangle, rectangular or as a polygon. In another implementation form, the bright zone 120 and/or the quiet zone 110 have another geometrical form, e.g. are formed as a square, as an ellipse, as a triangle, rectangular or as a polygon. The quiet zone 110 and the bright zone 120 may be arranged at any position within the desired reproduction region 130. In an implementation form, the at least one bright zone 120 and the at least one quiet zone 110 are not overlapping.

In this implementation form, the loudspeakers 102 are arranged on a semi-circle surrounding the desired reproduction region 130. At least two loudspeakers 102 are required to produce a desired sound field in the reproduction region 130. The more loudspeakers 102 are used the better sound reproduction can be achieved within the reproduction region 130. In another implementation form, the loudspeakers 102 are arranged on a full-circle around the desired reproduction region 130. In another implementation form, the loudspeakers 102 are arranged on a quarter-circle, on a square or on any other geometrical form around the desired reproduction region 130 or on a line in front of the desired reproduction region 130.

FIG. 1 depicts the audio rendering system 100 comprising the plurality of loudspeakers 102 arranged to approximate a desired spatial sound field S(x,k) within the desired reproduction region 130. The loudspeakers 102 are configured to approximate the sound field S(x,k) based on a weighted series of orthonormal basis functions $G_n(x,k)$ for the reproduction region 130.

A method to configure the loudspeakers 102 for approximating the desired sound field S(x,k) describes the desired sound field as an orthogonal expansion of basis functions for the reproduction region. This method does not only address the positioning of the loudspeakers but also the signals and gains which have to be applied to the loudspeakers in order to approximate the desired sound field. An arbitrary 2-D (height-invariant) soundfield function S(x,k) satisfying the wave equation can be considered as a superposition of an orthogonal set of solutions of the Helmholtz equation, such as given in E. G. Williams "Fourier Acoustics: Sound Radiation and Nearfield Acoustical Holography" Academic, New York, 1999. The orthogonality implies that the inner product of any two basis functions in the set over the desired reproduction region is 0. Therefore, the sound field S(x,k): $R^2 \times R \mapsto C$ can be written as a weighted series of basis functions $\{G_n\}$ $$S(x,k)=\sum_n C_n G_n(x,k)$$

on D. Importantly, assuming it is complete, $\{G_n\}$ forms an orthonomal set which can be used to describe an arbitrary 2-D sound field satisfying the wave equation within the desired region 130. In addition, a conventional weighting function w(x) as a function of x is introduced:

$$w(x)=\begin{cases} a, & x \in \text{the bright zone} \\ b, & x \in \text{the quiet zone} \\ c, & x \in \text{the unattended zone} \end{cases}.$$

With this weighting function w(x), the multi-zone system would generally approximate the desired sound field by solving the weighted least squares solution:

$$\min_{C_n} \int_D P \sum_n C_n G_n(x,k) - S(x,k) P^2 w(x)\,dx.$$

Note that this method will find the Helmholtz solution $C_n$ that is closest to the desired wavefield, in the least squares sense, according to any particular weighting function w(x), and can then best reproduce it. More specifically, w(x) enables controlling the reproduction accuracy over various types of zones by different settings. To illustrate this, if a value for w(x) in a selected bright zone 120 or quiet zone 110 is large, then the reproduction errors over this region will be harshly "punished" and the system 100 will render the wavefield over this region more accurately in the least squares sense. Naturally, a limited amount of acoustic leakage energy can be observed in the unattended zone 140. However, in a preferred implementation form, a relatively small value of weight is assigned to the unattended zone 140 because the leakage shall be limited, but not so much that it impacts the result in the bright 120 and quiet zones 110.

The Helmholtz solution $C_n$ can be obtained as follows:

$$C_n=\frac{\int_D S(x,k) G_n^*(x,k) w(x)\,dx}{\int_D G_n(x,k) G_n^*(x,k) w(x)\,dx},$$

where D marks the desired reproduction region 130. In a preferred implementation form, w(x) is chosen so that the set of $\{G_n\}$ is made orthonormal over D with the weighting function w(x), which implies that $\int_D G_i(x,k) G^*_j(x,k) w(x)\,dx=1$ only if i=j. With this setting, the denominator is 1, i.e. unity.

A set of plane wave functions $f_n(x,k)$ which represent plane waves arriving from $\phi_n=n\Delta\phi$ ($n=0, 1, \ldots, N=\lfloor 2\pi/\Delta\phi-1 \rfloor$), can be easily reproduced within the reproduction region 130 by using the existing reproduction methods. $\lfloor x \rfloor$ denotes the rounding operation to the closest lower integer.

The set of plane wave functions $f_n(x,k)$ can be described as follows:

$$f_n(x,k)=e^{ikx\phi_n},$$

where $\phi_n \equiv (1,\phi_n)$ is the direction of the plane waves. The orthogonal set $\tilde{f}_n(x,k)$ on D can be formed from a set of plane waves by means of a Gram-Schmidt process according to G. H. Golub and C. Van Loan "Matrix Computation" Johns Hopkins Univ., 3rd edition, October 1996 as:

$$\tilde{f}_n(x,k)=f_n(x,k)-\sum_{i=0}^{n-1}\frac{\int_D f_n(x,k)\tilde{f}_i^*(x,k) w(x)\,dx}{\int_D \tilde{f}_i(x,k)\tilde{f}_i^*(x,k) w(x)\,dx}\tilde{f}_i(x,k).$$

With this setup, the desired sound field $S^d(x,k)$ can be written as an orthogonal expansion of the basis functions $\tilde{f}_n(x,k)$ for the reproduction region D $$S^d(x,k) = \sum_n C_n^d \tilde{f}_n(x,k), \text{ where}$$

$$C_n^d = \int_D S^d(x,k)\tilde{f}_n^*(x,k)w(x)\,dx.$$

$$\text{with } \int_D w(x)\tilde{f}_n(x,k)\tilde{f}_n^*(x,k)\,dx = 1.$$

In order to recreate the desired multi-zone sound field within the desired region 130, the entire desired region 130 including both the bright zone 120 and the quiet zone 110 is matched by this method and then the apertures are computed by summing the apertures for the basis functions. The basis functions of the orthogonal set are also linear combination of plane waves coming from various angles. To obtain the coefficients for the plane wave functions, a linear system of equations is constructed as follows:

$$\tilde{f}=Af,$$

where $f=[f_0(x,k), \ldots, f_N(x,k)]_T$, $\tilde{f}=[\tilde{f}_0(x,k), \ldots, \tilde{f}_N(x,k)]_T$, and A is a lower triangular matrix. $A_{ij}$ denotes the coefficients for the j th plane wave $f_{j-1}(x,k)$ within the i th individual basis function $\tilde{f}_{i-1}(x,k)$. A is calculated based on the introduced Gram Schmidt process, where the relation $A_{ij}=1$ if i=j holds. So, the result is:

$$A = \begin{bmatrix} 1 & \cdots & \cdots & 0 \\ A_{21} & 1 & \cdots & 0 \\ \vdots & \vdots & \ddots & \vdots \\ A_{(N+1)(1)} & \cdots & A_{(N+1)(N)} & 1 \end{bmatrix}.$$

Then, the result is $$S^d(x,k)=C^d\tilde{f},$$

where $C^d=[C_0^d, \ldots, C_N^d]$. The desired sound field can be written as $$S^d(x,k)=C^dAf.$$

Therefore, $p=C^dA$ specifies the coefficients for the plane wave functions to reproduce the desire sound field, where p=[p(0), . . . , p(N)]. With the coefficients p the existing 2-D reproduction method can easily be applied to recreate the desired multi-zone sound field due to its linearity.

The reproduced sound field can be expressed by using the discrete circular loudspeaker array with weights as:

$$S_{disc}^a(x,k) = \sum_{q=1}^{Q} w_q(k)\frac{i}{4}H_0^{(1)}(k\|R\hat{\phi}_q - x\|),$$

where Q represents the minimum number of required loudspeakers and $R\hat{\phi}_q$ marks the positions of loudspeakers. Especially $w_q(k)$ specifies the weighted driven functions to the qth loudspeaker according to the calculated coefficients of the basis wavefields.

$H_0^{(1)}(k\|\ldots\|)$ is a zeroth-order Hankel function of the first kind.

In an alternative implementation form, the "Householder transformation" is used to construct the orthogonal set.

However as preferred implementation form, an iterative method is applied to calculate the coefficients for basis plane waves, which makes the Gram-Schmidt process more applicable.

The rationale of the semi-circle reproduction method, i.e. a method for configuration of loudspeakers arranged on a semi-circle, is to diminish the number of the active loudspeakers to approximately half of counterpart proposed in existing reproduction method, e.g., the number of required loudspeakers in Y. J. Wu and T. D. Abhayapala "Theory and design of soundfield reproduction using continuous loudspeaker concept" IEEE Trans. Acoust., Speech, Signal Processing, 17(1):107-116, January 2009, for a reproduction region of radius r is Q=2M+1, where M=⌈kr⌉ is the length of truncation modes.

In the following, the mathematical optimization problem for loudspeakers arranged on a semi-circle is defined. The essence of this problem is to find a set of Fourier coefficients for the aperture function, such that it can be used to approximate the desired sound field, and also meets the constraint of semi-circle design. A method to solve the formulated problem is presented in the following.

The loudspeaker aperture function ρ(ϕ,k) on a full circle can be written as a Fourier series expansion as it is a periodic function of the angle ϕ:

$$\rho(\phi,k) = \sum_{m=-\infty}^{\infty} \beta_m(k)e^{im\phi},$$

where $\{\beta_m(k)\}$ are the Fourier coefficients.

The most natural formulation of the optimization problem is to find the set of $\{\beta_m(k)\}$ that minimizes the error function and let it be as close as possible to $$\frac{2}{i\pi H_m^{(1)}(kR)}\alpha_m^{(d)}(k),$$

which is the desired value of the Fourier coefficients to calculate the aperture function for the full circular continuous loudspeaker. So this results in:

$$f(\{\beta_m(k)\}) = \sum_{m=-\infty}^{\infty}\left|\beta_m(k) - \frac{2}{i\pi H_m^{(1)}(kR)}\alpha_m^{(d)}(k)\right|^2,$$

subject to the $\eta_c$ which ideally sets the value of the aperture function ρ(ϕ,k) to zero when $\phi<\phi_0$ ($\phi_0=\pi$ is set for the semi-circle method):

$$\eta_c = \int_0^{2\pi}\left|\sum_{m=-\infty}^{\infty}(\beta_m(k)e^{im\phi})(1 - \Pi(\phi,\phi_0))\right|^2 d\phi,$$

The factor $\Pi(\phi,\phi_0)$ represents the angular window function defined as:

$$\Pi(\phi,\phi_0)=\{0, 0\le\phi<\phi_0 1, \phi_0\le\phi<2\pi.$$

To find the solution of the optimization problem, as a preferred embodiment, the method of Lagrange multipliers can be used. That is to minimize an expression of the form $$\eta_0=f(\{\beta_m(k)\})+\lambda\eta_c$$

where $\eta_0$ is the overall error that is minimized and where $\eta_c$ represents the constraint.

From an alternative viewpoint, it can be seen that it defines a weighting between the constraint and the function $f$ that is determined by $\lambda$.

Note that it is impossible to find a reasonable solution satisfying the constraint $\eta_c$. If the setting $\lambda=0$ is applied, then the constraint is ignored and the solution is the same circumstance as the aperture function of full circular continuous loudspeaker. For emphasizing the constraint error, a sufficiently large $\lambda$ is selected to make sure the constraint $\eta_c$ is small.

A difficulty with the minimization of the overall error $\eta_0$ is that the criterion is not an analytic function, i.e., it does not satisfy the Cauchy-Riemann conditions. While the problem likely is analytically solvable with the methodology described in David G. Messerschmitt "Stationary points of a real-valued function of a complex variable" Technical Report UCB/EECS-2006-93, EECS Department, University of California, Berkeley, June 2006, a brute-force approach is used here for a first solution.

The set of Fourier coefficients $\beta_m^d$ (k) is searched for, which minimizes the overall error $\eta_0$. $\lambda$ is set to a large value to emphasize the constraint error. The basic idea is to start with an arbitrary initial set of $\{\beta_m^d(k)\}$, add a random vector with fixed norm, and either accept or reject this change based on whether the measure $\eta_0$ decreases. A random walk is created that will generally end in the nearest local minimum. In an implementation form, the algorithm is optimized by adjusting the stepsize, a convex optimization provides a methodology to find a good schedule for this. But a simple algorithm with fixed step size is used here. Thus, a set of $\{\beta_m^d(k)\}$ is found that minimizes $\eta_0$, within approximately one step size of the random vectors. This solution is then used to calculate the loudspeaker weights in the desired non-zero aperture region required for approximately reproducing the desired sound field within the reproduction region 130. The solution of $\{\beta_m^d(k)\}$ is then used to describe the loudspeaker weight $l_q(k)$:

$$l_q(k) = \sum_{m=-M}^{M} \beta_m^d(k) e^{im\phi_q} \Delta\phi_s.$$

where $\Delta\phi_s=2\pi/Q$ is the angular spacing of the loudspeakers and $\phi_q=q\Delta\phi_s$. $S_{disc}^a(x,k)$ is defined as the reproduced sound field using the semi-circle method with weights provided by $l_q(k)$. Then $$S_{disc}^a(x, k) = \sum_q l_q(k) \frac{i}{4} H_0^{(i)}(kPR\phi_q - xP),$$

where $\phi_q=(1,\phi_q)$ and R is the radius of the semi-circle where the loudspeakers 102 are located.

Figure 2:
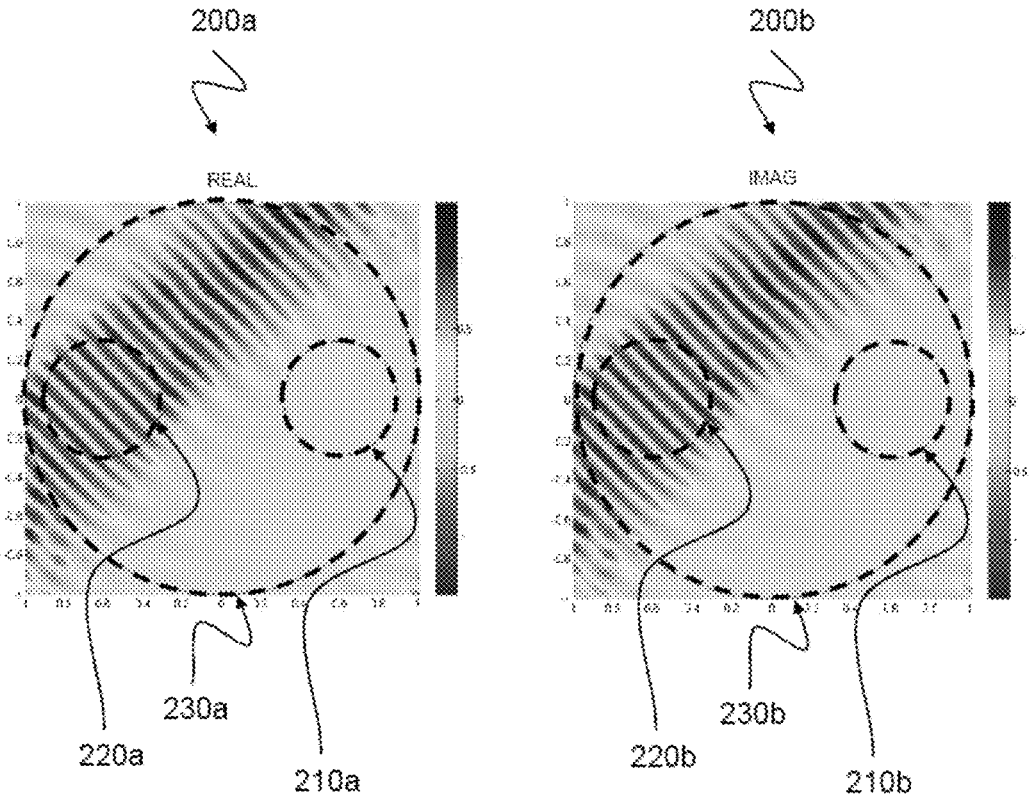
FIG. 2 shows two schematic diagrams representing real and imaginary part respectively of a sound field reproduction according to a first multi-zone reproduction scenario.

FIG. 2 shows two schematic diagrams 200*a*, 200*b* representing real and imaginary part respectively of a sound field reproduction according to a first multi-zone reproduction scenario. The desired multi-zone sound field is described with a basis expansion. A plane wave is created at $\phi_d=45°$ in the bright zone 220*a*, 220*b* which is located at $\phi_1=180°$ while the quiet zone 210*a*, 210*b* is located at $\phi2=0°$. The angles $\phi_1=180°$ and $\phi_2=0$ are related to the center of the reproduction area 230*a*, 230*b* as described above with respect to FIG. 1. The weighting function w(x) is assigned as: a=1, b=2.5 and c=0.05. Left and right plots represent real and imaginary parts respectively.

Multi-zone reproduction is considered in two zones, one bright zone 220*a*, 220*b* and one quiet zone 210*a*, 210*b*, each of radius 0.3 meters (m) within the desired reproduction region 230*a*, 230*b* of radius r=1 m at the frequency of $f$=2000 hertz (Hz). The distance between the centres of $D_b$ 220*a*, 220*b* and $D_q$ 210*a*, 210*b* is 0.6 m. The target bright 220*a*, 220*b* and quiet 210*a*, 210*b* zones are located at $\phi_1$ and $\phi_2$ respectively as shown in FIG. 2. A plane wave is reproduced at angle $\phi_d$ from the x-axis in the selected bright zone 220*a*, 220*b*, whilst deadening the sound in the quiet zone 210*a*, 210*b*. In FIG. 2, a plane wave is created at $\phi_d=45°$ in the bright zone 220*a*, 220*b* which is located at $\phi_1=180°$ while the quiet zone 210*a*, 210*b* is located at $\phi_2=0$. Here, the weighting function w(x) is set as: a=1, b=2.5 and c=0.05. $\Delta\phi=\pi/40$ is set, which represents the degree of freedom, i.e., the number of orthogonal waves in the set, is 80. From FIG. 2, it can be seen that the synthesized multi-zone sound field corresponds well to the desired field.

Figure 3:
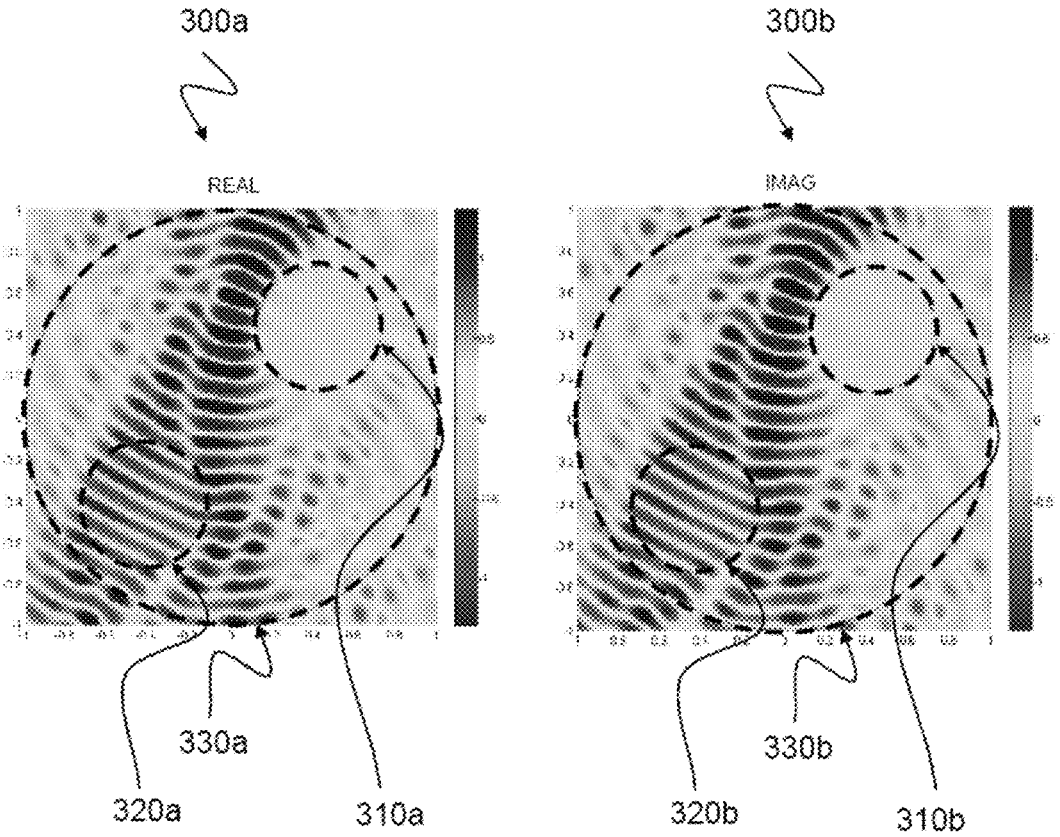
FIG. 3 shows two schematic diagrams representing real and imaginary part respectively of a sound field reproduction according to a second multi-zone reproduction scenario.

FIG. 3 shows two schematic diagrams representing real 300*a* and imaginary 300*b* parts respectively of a sound field reproduction according to a second multi-zone reproduction scenario. The desired multi-zone sound field is described with a basis expansion. A plane wave is created at $\phi_d=60°$ in the bright zone 320*a*, 320*b* which is located at $\phi_1=225°$ while the quiet zone 310*a*, 310*b* is located at $\phi_2=45°$. The angles $\phi_1=225°$ and $\phi_2=45°$ are related to the center of the reproduction area 330*a*, 330*b* as described above with respect to FIG. 1. The weighting function w(x) is assigned as: a=1, b=2.5 and c=0.05. Left and right plots represent real and imaginary parts respectively. FIG. 3 shows a multi-zone reproduction scenario which is more challenging than the scenario described with respect to FIG. 2. Since the plane wave is almost collinear with a line drawn through the centres of the two zones, sound field created in the bright zone 320*a*, 320*b* propagates straight into the quiet zone 310*a*, 310*b* if not for multi-zone compensation. The overall system performance can be adjusted by changing the values of the parameters in the weighting function based on real setting and practical requirements.

Figure 4:
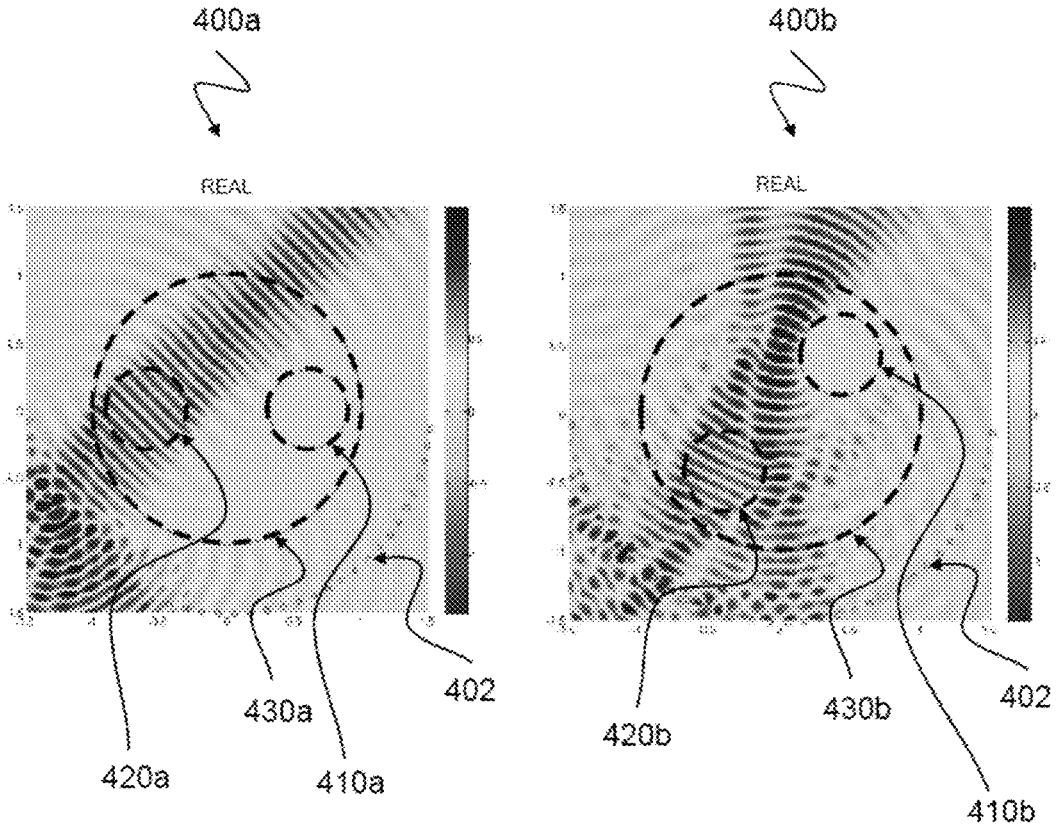
FIG. 4 shows two schematic diagrams representing real parts of the first multi-zone reproduction scenario and the second multi-zone reproduction scenario respectively using a semi-circle arrangement of loudspeakers.

FIG. 4 shows two schematic diagrams representing real parts of the first multi-zone reproduction scenario 400*a* and the second multi-zone reproduction scenario 400*b* respectively using a semi-circle arrangement of loudspeakers 402. The desired multi-zone reproduction is using the approach of semi-circle with the same weighting function w(x) setting at the frequency of 2000 Hz. In this implementation form, a number of 39 loudspeakers 402 are used. Left and right plots represent the first scenario with $\phi_d=45°$ and the second scenario with $\phi_d=60°$ respectively. Overall, the number of the employed loudspeakers 402 is 39 and only the lower part of loudspeakers 402 are used, while a circular array of at least 77 loudspeakers is required using the prior art reproduction method. Half of the orthogonal set are merely adopted which consists of basis plane wavefields with arriving angles from 0 to $\pi$. The rationale of doing this is that sound waves cannot be rendered travelling towards the semi-circle of loudspeakers and the introduction of the other half of the orthogonal set which consists in basis plane wavefields with arriving angles from $\pi$ to $2\pi$ would lead to large reproduction errors overall. The loudspeakers are located on a half circle with a radius of R=1.5 m. The reproduced multi-zone sound fields in FIG. 4 correspond well to the desired fields within the reproduction region 430*a*, 430*b*.

Figure 5:
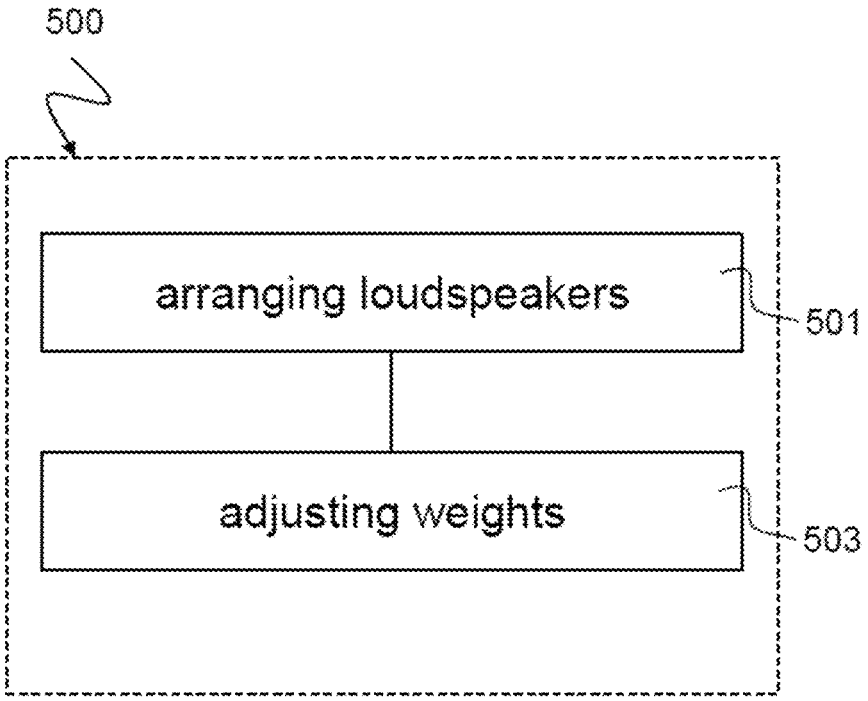
FIG. 5 shows a schematic diagram of a method for sound field reproduction according to an implementation form.

FIG. 5 shows a schematic diagram of a method 500 for sound field reproduction according to an implementation form.

The method 500 comprises arranging 501 a plurality of loudspeakers for approximating a desired spatial sound field S(x,k) within a predetermined reproduction region D, wherein the loudspeakers are configured to approximate the sound field S(x,k) based on a weighted series of orthonormal basis functions $G_n(x,k)$ for the reproduction region D. The method 500 further comprises adjusting 503 the weights of the weighted series for approximating the desired sound field S(x,k).

In an implementation form, the weights $C_n$ of the weighted series are adjusted for approximating the desired sound field S(x,k). In an implementation form, the loudspeakers are configured to reproduce the desired sound field S(x,k) at a predetermined frequency. In an implementation form, the sound field S(x,k) comprises at least one bright zone B and at least one quiet zone Q. In an implementation form, the weights $C_n$ of the weighted series are adjusted by determining a weighted w(x) least squares solution of the weighted series of orthonormal basis functions $G_n(x,k)$ with respect to the desired sound field S(x,k). In an implementation form, the weighted w(x) least squares solution is according to:

$$\min_{C_n} \int_D P \sum_n C_n G_n(x, k) - S(x, k) P^2 w(x)\, dx.$$

where S(x,k) denotes the desired sound field, $G_n(x,k)$ denotes the orthonormal basis functions, $C_n$ denotes the weights of the weighted series, w(x) denotes a weighting function and D denotes the desired reproduction region. In an implementation form, a weighting function w(x) of the weighted least squares solution depends on the at least one bright zone B, the at least one quiet zone Q and on an unattended zone U. In an implementation form, the weighting function w(x) of the weighted least squares solution comprises at least a first weight "a" over the at least one bright zone, a second weight "b" over the at least one quiet zone Q and a third weight "c" over the unattended zone U. In an implementation form, the orthonormal basis functions $G_n(x,k)$ are derived from at least a set of plane waves or a set of circular waves. In an implementation form, the orthonormal basis functions $G_n(x,k)$ are formed by using a Gram Schmidt process with a set of solutions $C_n$ of the Helmholtz equation as input or by using a Householder transformation. In an implementation form, the Gram Schmidt process is applied on a set of one of plane waves and circular waves. In an implementation form, the loudspeaker configuration for approximating the desired sound field based on the weighted series of orthonormal basis functions is computed based on known loudspeaker weights for each wave of the set of plane waves or the set of circular waves. In an implementation form, the plurality of loudspeakers is arranged on a circle, a semi-circle, a quarter-circle, a square or a line.

Figure 6:
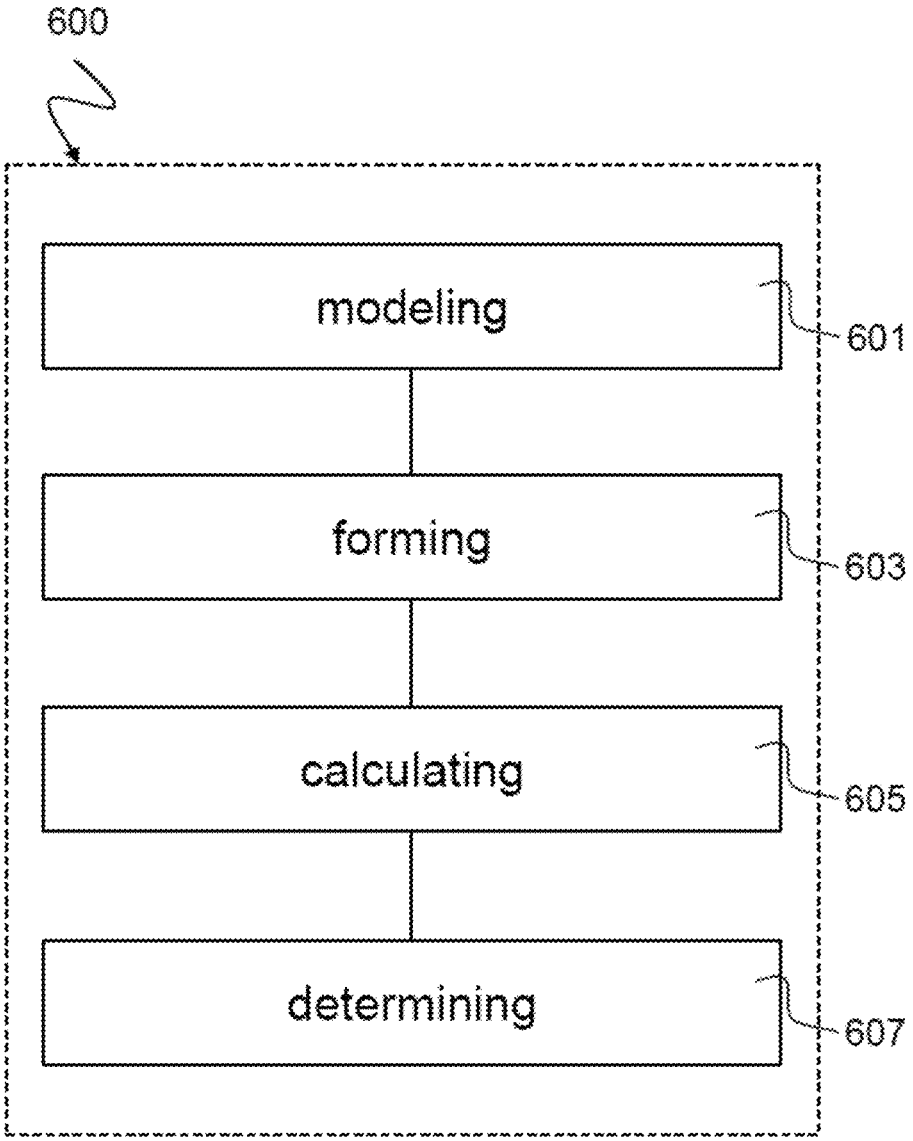
FIG. 6 shows a schematic diagram of a method for reproducing a sound field within a desired reproduction region at a certain frequency according to an implementation form.

FIG. 6 shows a schematic diagram of a method 600 for reproducing a sound field within a desired reproduction region at a certain frequency according to an implementation form. The method 600 comprises modeling 601 the sound field as an orthogonal expansion of basis functions for the desired reproduction region. The method 600 comprises forming 603 the orthogonal expansion of basis functions by using a Gram Schmidt process. The method 600 comprises calculating 605 coefficients of the basis functions. The method 600 comprises determining 607 loudspeaker weights for the sound field based on the calculated coefficients.

From the foregoing, it will be apparent to those skilled in the art that a variety of methods, systems, computer programs on recording media, and the like, are provided.

The present disclosure also supports a computer program product including computer executable code or computer executable instructions that, when executed, causes at least one computer to execute the performing and computing steps described herein.

Many alternatives, modifications, and variations will be apparent to those skilled in the art in light of the above teachings. Of course, those skilled in the art readily recognize that there are numerous applications of the invention beyond those described herein. While the present inventions has been described with reference to one or more particular embodiments, those skilled in the art recognize that many changes may be made thereto without departing from the scope of the present invention. It is therefore to be understood that within the scope of the appended claims and their equivalents, the inventions may be practiced otherwise than as specifically described herein.

What is claimed is:

1. An audio rendering system, comprising:

a plurality of loudspeakers arranged to approximate a desired spatial sound field within a predetermined reproduction region, wherein the loudspeakers are configured to approximate the sound field based on a weighted series of orthonormal basis functions for the reproduction region, and wherein the orthonormal basis functions are formed using a Gram Schmidt process with a set of solutions of the Helmholtz equation as input or using a Householder transformation.

2. The audio rendering system of claim 1, wherein the weights of the weighted series are adjusted for approximating the desired spatial sound field.

3. The audio rendering system of claim 1, wherein the loudspeakers are configured to reproduce the desired spatial sound field at a predetermined frequency.

4. The audio rendering system of claim 1, wherein the desired spatial sound field comprises at least one bright zone and at least one quiet zone.

5. The audio rendering system of claim 1, wherein the weights of the weighted series are adjusted by determining a weighted least squares solution of the weighted series of orthonormal basis functions with respect to the desired sound field.

6. The audio rendering system of claim 5, wherein the weighted least squares solution is according to:

$$\min_{C_n} \int_D P \sum_n C_n G_n(x, k) - S(x, k) P^2 w(x)\, dx,$$

wherein S(x,k) denotes the desired sound field, $G_n(x,k)$ denotes the orthonormal basis functions, $C_n$ denotes the weights of the weighted series, w(x) denotes a weighting function and D denotes the desired reproduction region.

7. The audio rendering system of claim 4, wherein a weighting function of the weighted least squares solution depends on the at least one bright zone, the at least one quiet zone and a remaining unattended zone in the desired reproduction region.

8. The audio rendering system of claim 7, wherein the weighting function of the weighted least squares solution comprises at least a first weight over the at least one bright zone, a second weight over the at least one quiet zone and a third weight over the unattended zone.

9. The audio rendering system of claim 1, wherein the orthonormal basis functions are derived from at least a set of plane waves or a set of circular waves.

10. The audio rendering system of claim 1, wherein the Gram Schmidt process is applied on a set of one of plane waves and circular waves.

11. The audio rendering system of claim 10, wherein the configuration of the loudspeakers for approximating the desired sound field based on the weighted series of orthonormal basis functions is computed based on known weights of the loudspeakers for each wave of the set of plane waves or the set of circular waves.

12. The audio rendering system of claim 1, wherein the plurality of loudspeakers are arranged on a circle, a semicircle, a quarter-circle, a square or a line.

13. A method for sound field reproduction, comprising:

arranging a plurality of loudspeakers for approximating a desired spatial sound field within a predetermined reproduction region, wherein the loudspeakers are configured to approximate the desired spatial sound field based on a weighted series of orthonormal basis functions for the reproduction region, and wherein the orthonormal basis functions are formed using a Gram Schmidt process with a set of solutions of the Hemholtz equation as input or using a Householder transformation; and adjusting the weights of the weighted series for approximating the desired spatial sound field.

14. A method for reproducing a sound field within a desired reproduction region at a certain frequency, comprising:

modeling the sound field as an orthonormal expansion of basis functions for the desired reproduction region;

forming the orthonormal expansion of basis functions by using a Gram Schmidt process;

calculating coefficients of the basis functions; and determining loudspeaker weights for the sound field based on the calculated coefficients.

15. An audio rendering system, comprising:

a plurality of loudspeakers arranged to approximate a desired spatial sound field within a predetermined reproduction region, wherein the loudspeakers are configured to approximate the sound field based on a weighted series of orthonormal basis functions for the reproduction region, wherein the weights of the weighted series are adjusted by determining a weighted least squares solution of the weighted series of orthonormal basis functions with respect to the desired sound field, wherein the weighted least squares solution is calculated according to:

$$\min_{C_n} \int_D P \sum_n C_n G_n(x, k) - S(x, k) P^2 w(x) dx.,$$

wherein S(x,k) denotes the desired sound field, $G_n(x,k)$ denotes the orthonormal basis functions, $C_n$ denotes the weights of the weighted series, w(x) denotes a weighting function and D denotes the desired reproduction region.

* * * * *